US012559913B2

(12) United States Patent
Sartori et al.

(10) Patent No.: US 12,559,913 B2
(45) Date of Patent: Feb. 24, 2026

(54) HYDRAULIC PRESSURE RELIEF CONTROL SYSTEM FOR UTILITY VEHICLE

(71) Applicant: THE TORO COMPANY, Bloomington, MN (US)

(72) Inventors: Stephen J. Sartori, Bloomington, MN (US); Adam J. Lorang, Lake Elmo, MN (US); Matthew B. Rens, Burnsville, MN (US); Samuel S. Zayed, Bloomington, MN (US)

(73) Assignee: THE TORO COMPANY, Bloomington, MN (US)

( * ) Notice: Subject to any disclaimer, the term of this patent is extended or adjusted under 35 U.S.C. 154(b) by 0 days.

(21) Appl. No.: 18/797,733

(22) Filed: Aug. 8, 2024

(65) Prior Publication Data

US 2025/0059730 A1 Feb. 20, 2025

Related U.S. Application Data

(60) Provisional application No. 63/532,999, filed on Aug. 16, 2023.

(51) Int. Cl.
*E02F 9/22* (2006.01)

(52) U.S. Cl.
CPC ..... *E02F 9/2267* (2013.01); *E02F 9/2228* (2013.01)

(58) Field of Classification Search
CPC ..... E02F 9/2025
See application file for complete search history.

(56) References Cited

U.S. PATENT DOCUMENTS

| | | | | |
|---|---|---|---|---|
| 4,881,371 | A * | 11/1989 | Haeder | B60R 16/00 60/431 |
| 4,949,805 | A * | 8/1990 | Mather | E02F 9/2025 180/324 |
| 6,837,319 | B2 * | 1/2005 | Dvorak | E02F 3/3604 180/324 |
| 7,117,952 | B2 * | 10/2006 | Bares | E02F 3/405 37/238 |
| 8,109,356 | B2 * | 2/2012 | Brock | E02F 9/2271 180/308 |
| 8,807,263 | B2 * | 8/2014 | Caillieret | E02F 9/2271 180/305 |
| 11,618,324 | B2 * | 4/2023 | Sosnowski | H02P 3/18 180/65.31 |
| 2015/0020892 | A1 * | 1/2015 | Behr | E02F 3/3672 137/15.09 |
| 2019/0160643 | A1 * | 5/2019 | Lefavour | B25F 5/005 |

OTHER PUBLICATIONS

U.S. Appl. No. 63/532,999, filed Aug. 16, 2023, Sartori et al.

* cited by examiner

*Primary Examiner* — Thomas E Lazo
(74) *Attorney, Agent, or Firm* — Mueting Raasch Group

(57) ABSTRACT

A utility vehicle, control system, and method are described to allow relief of hydraulic pressure in a hydraulic system of the vehicle once the source of hydraulic pressure (e.g., pump) is de-energized. In some embodiments, a hydraulic control input is provided and operably coupled to the hydraulic system, and an operator control switch is provided and also operably coupled to the hydraulic system. The operator control switch has at least two positions, wherein pressure within the hydraulic system is relieved when the operator control switch is in a relief position and the hydraulic control input is engaged.

17 Claims, 4 Drawing Sheets

HYDRAULIC PRESSURE RELIEF CONTROL SYSTEM FOR UTILITY VEHICLE

The present application claims priority to and/or the benefit of U.S. Provisional Patent Application No. 63/532,999, filed Aug. 16, 2023, which is incorporated herein by reference in its entirety.

Embodiments of the present disclosure relate to stand-on or walk-behind utility loaders and to hydraulic pressure relief of the same.

BACKGROUND

Utility vehicles such as compact utility loaders controlled by a stand-on or walk-behind operator (such loaders being referred to herein as "SOWB loaders") are known for performing various types of work in outdoor and indoor environments. Often utility loaders are configured with a connection apparatus to permit attachment of any one of a variety of attachment tools. These attachment tools may be supplied with hydraulic fluid, by the utility loader, through the connection apparatus to operate the attachment tool. Specifically, the connection apparatus may include a hydraulic coupler (e.g., a quick coupler) to conveniently attach the attachment tool to the loader and remove the attachment tool from the loader.

During operation of the attachment tool, the hydraulic system operably connected thereto may become pressurized. Specifically, pressurized hydraulic fluid may be present between the hydraulic coupler and a valve of the hydraulic system. Such pressurized hydraulic fluid may prevent, or otherwise interfere with, connecting or disconnecting the attachment tool to the hydraulic coupler. Therefore, the pressure may need to be relieved between the hydraulic coupler and the valve before any connection/disconnection actions are taken using the hydraulic coupler.

SUMMARY

Embodiments of the present disclosure may provide a control system of a utility vehicle, the control system including: a hydraulic control input operably coupled to a hydraulic system of the utility vehicle and configured to move one or more components associated with the hydraulic system; and an operator control switch operably coupled to the hydraulic system. The switch includes at least two positions, wherein pressure within the hydraulic system is relieved when the operator control switch is in a relief position and the hydraulic control input is engaged.

In another embodiment, a utility vehicle is provided that includes: a frame; an electric motor supported on the frame; a hydraulic system operably coupled to the electric motor, wherein the hydraulic system is configured to provide hydraulic power to one or more components of the utility vehicle; a hydraulic control input operably coupled to the hydraulic system and configured to move the one or more components; and an operator control switch operably coupled to the hydraulic system. The control switch includes at least two positions, wherein pressure within the hydraulic system is relieved when the operator control switch is in a relief position and the hydraulic control input is engaged.

In still another embodiment, a method of controlling a utility vehicle is provided, wherein the method includes: selecting a relief position of an operator control switch, wherein the operator control switch is operably coupled to a hydraulic system of the utility vehicle and comprises at least two positions; and engaging a hydraulic control input while the relief position of the operator control switch is selected to relieve pressure within the hydraulic system, wherein the hydraulic control input is coupled to the hydraulic system and configured to move one or more components associated with the hydraulic system.

The above summary is not intended to describe each embodiment or every implementation. Rather, a more complete understanding of illustrative embodiments will become apparent and appreciated by reference to the following Detailed Description of Exemplary Embodiments and claims in view of the accompanying figures of the drawing.

BRIEF DESCRIPTION OF THE VIEWS OF THE DRAWING

Exemplary embodiments will be further described with reference to the figures of the drawing, wherein.

Figure 1:
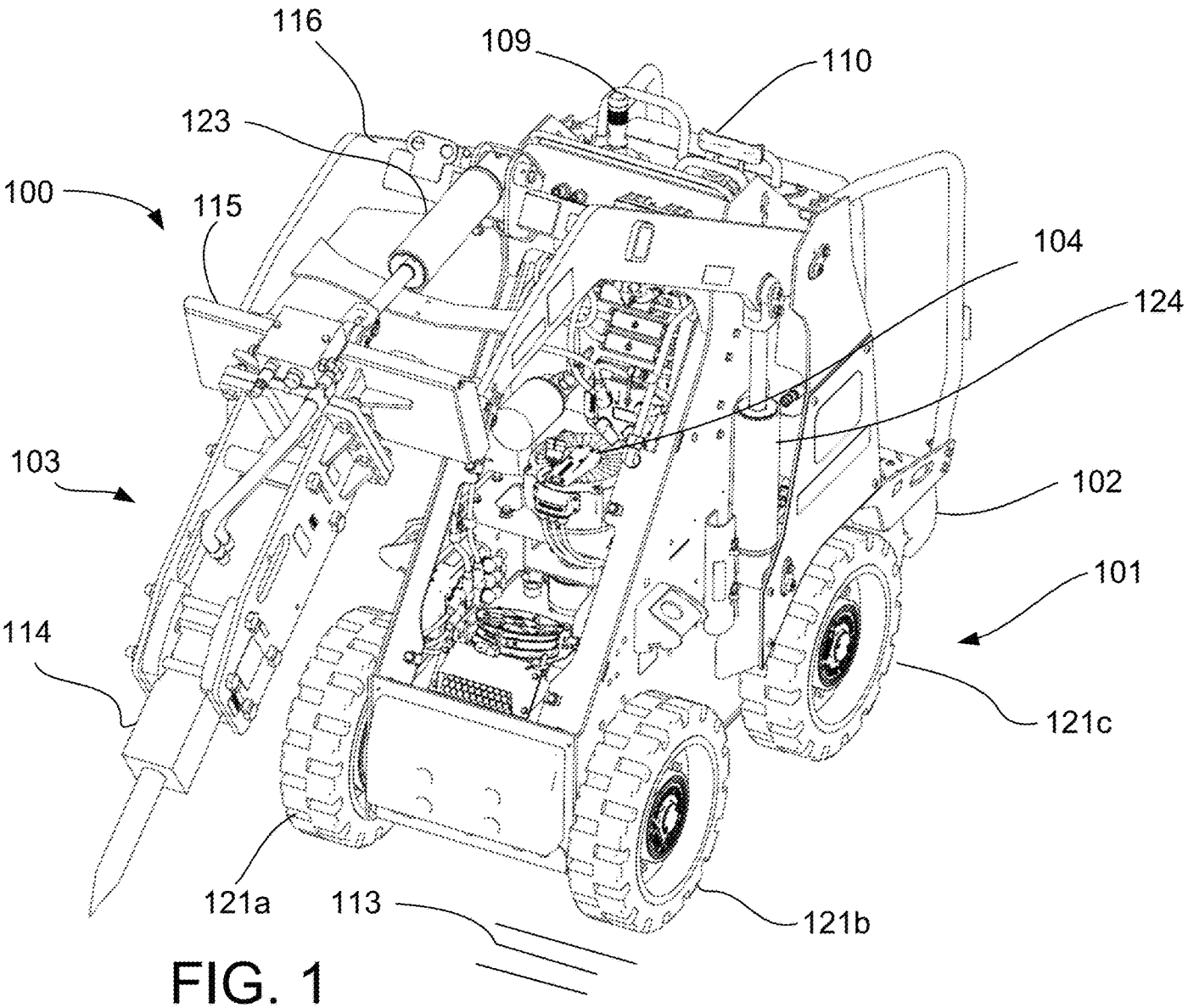
FIG. 1 is a perspective view of a utility vehicle in accordance with one embodiment of the present disclosure.

The figures are rendered primarily for clarity and, as a result, are not necessarily drawn to scale. Moreover, various structure/components, including but not limited to fasteners, electrical components (wiring, cables, etc.), and the like, may be shown diagrammatically or removed from some or all of the views to better illustrate aspects of the depicted embodiments, or where inclusion of such structure/components is not necessary to an understanding of the various exemplary embodiments described herein. The lack of illustration/description of such structure/components in a particular figure is, however, not to be interpreted as limiting the scope of the various embodiments in any way.

DETAILED DESCRIPTION OF EXEMPLARY EMBODIMENTS

In the following detailed description of illustrative embodiments, reference is made to the accompanying figures of the drawing which form a part hereof. It is to be understood that other embodiments, which may not be described and/or illustrated herein, are certainly contemplated.

All headings provided herein are for the convenience of the reader and should not be used to limit the meaning of any text that follows the heading, unless so specified. Moreover, unless otherwise indicated, all numbers expressing quantities, and all terms expressing direction/orientation (e.g., vertical, horizontal, parallel, perpendicular, etc.) in the specification and claims are to be understood as being modified in all instances by the term "about." The term "and/or" (if used) means one or all of the listed elements or a combination of any two or more of the listed elements. "I.e." is used as an abbreviation for the Latin phrase id est and means "that is." "E.g." is used as an abbreviation for the Latin phrase exempli gratia and means "for example."

With reference to the figures of the drawing, wherein like reference numerals designate like parts and assemblies throughout the several views, FIG. 1 illustrates a utility vehicle 100 in accordance with exemplary embodiments of the present disclosure. While shown in these views as a self-propelled, stand-on utility vehicle 101 (also referred to herein simply as a "vehicle" or "machine"), such a configuration is not limiting. That is, while embodiments are described herein with respect to a stand-on utility vehicle, those of skill in the art will realize that this disclosure is equally applicable to other types of vehicles (e.g., walk-behind or sit-on), as well as to other types of wheeled or tracked maintenance vehicles (e.g., mowers, debris management systems (e.g., blowers, vacuums, sweepers, etc.), general purpose utility vehicles or machines, and the like) without limitation. That is to say, the terms "utility vehicle" or "utility machine" are understood herein to include utility vehicles or machines intended for operation, indoors or outdoors, and upon either or both of turf (e.g., grass) and non-turf (e.g., concrete) surfaces.

It is noted that the terms "have," "includes," "comprises," and variations thereof do not have a limiting meaning and are used in the open-ended sense to generally mean "including, but not limited to," where the terms appear in the accompanying description and claims. Further, "a," "an," "the," "at least one," and "one or more" are used interchangeably herein. Moreover, relative terms such as "left," "right," "front," "fore," "forward," "rear," "aft," "rearward," "top," "bottom," "side," "upper," "lower," "above," "below," "horizontal," "vertical," and the like can be used herein and, if so, are from the perspective shown in the particular figure, or while the vehicle 100 is in an operating configuration, e.g., while the vehicle 100 is positioned on a ground surface 113 as shown in FIG. 1. These terms are used only to simplify the description, however, and not to limit the interpretation of any embodiment described. In a similar manner, terms such as "first" and "second" may be used herein to describe various elements. However, such terms are used merely to simplify identification of the element(s). Accordingly, if an element is described as "first," there may or may not be subsequent elements—that is, a "second" element is not necessarily present. It is further understood that the description of any particular element as being operably attached, connected, or coupled to another element may indicate that the elements are either directly attached, connected, or coupled to one another, or are indirectly attached, coupled, or connected to one another via intervening elements.

Embodiments described and illustrated herein are directed to a utility vehicle (e.g., a compact utility loader) that accommodates an operator either: standing upon a platform attached to the vehicle (e.g., at a back end of the loader); or walking behind the vehicle. For example, such vehicles having an operator standing upon a platform or walking behind the vehicle may be referred to herein as a "SOWB loader." In one or more embodiments, the utility vehicles described herein may include an operator seated on the vehicle and may be described as sit-down/sit-in and/or ride-on. Further, for example, the utility vehicle described herein may include small articulated loaders and/or conventional skid-steer loaders.

Specifically, embodiments of the present disclosure may include a control system of the utility vehicle that is operably connected to an attachment tool for movement of the same. Further, the attachment tool (e.g., a hydraulic attachment) may be controlled through a hydraulic system. During operation, the hydraulic system may be pressurized, but the pressure in the hydraulic system may be relieved to disconnect (or connect) the attachment tool. For example, in one or more embodiments, the hydraulic system may include quick couplers to easily attach and detach the attachment tool. However, the pressure within the hydraulic system may need to be relieved to operate the quick couplers (e.g., attachment/detachment may not be successful when the hydraulic system is at a high pressure). In one or more embodiments, the pressure within the hydraulic system may be relieved manually or electrically.

Specifically, in order to depressurize the hydraulic system, a solenoid or actuator associated with the hydraulic tool is activated without the pump being powered on or activated. Often electronic systems of the utility vehicle are either on or off and, therefore, are not set up to activate the hydraulic tool while the pump is powered off. The present disclosure provides a control system in which the solenoids or actuators may be activated while the pump is powered off, e.g., to depressurize the hydraulic system.

With this introduction, FIG. 1 illustrates a vehicle 100 (e.g., loader) in accordance with embodiments of the present disclosure. The vehicle 100 may accommodate a variety of working tools or attachments used, e.g., by landscape contractors, to perform various tasks. For example, a bucket can be attached to the vehicle 100 for scooping, carrying, and emptying (e.g., into a dump truck) dirt or other material. The vehicle 100 may accommodate other tools including, for example, a reciprocating hammer, forks, a vibratory plow, a grapple rake, a trencher, a leveler, a box rake, a soil cultivator, a snowthrower, a stump grinder, a tiller, an auger, a hydraulic breaker, and a plow blade, among others.

While utility loaders like those described herein may vary in size, an exemplary compact utility vehicle in accordance with embodiments of the present disclosure may be of a size that permits the vehicle to access areas generally inaccessible by larger skid steer loaders (e.g., areas with confined entries such as gates or doorways, or areas that are unable to support the weight of a typical skid steer loader). For example, a compact utility loader like that shown in FIG. 1 may have a fore-and-aft, ground engagement contact pad (e.g., ground/track engagement) of 60 inches or less, an overall length (without tool) of 110 inches or less, a height of 80 inches or less, and a maximum width of 60 inches or less. For instance, the vehicle 100 of FIG. 1 may have a ground engagement contact pad of 50 inches, a length of 103 inches (and a length of 130 inches with a bucket attached), a height of 61 inches (corresponding to a height of 67 inches at the top of the arm/carrier), and a width of 54 inches. However, such specific dimensions are exemplary only and loaders of other sizes are certainly contemplated within the scope of this disclosure. One embodiment of such utility loader is shown in U.S. Pat. No. 11,618,324.

The vehicle 100 may include a suitably shaped chassis or frame 102 on which a prime mover, such as an electric motor 104, is supported or carried. Further, the chassis or frame 102 may be supported upon the ground surface 113 by independently driven ground-engaging members 121. The vehicle may include any suitable number of ground-engaging members 121. For example, in one embodiment, the vehicle includes first, second, third, and fourth ground-engaging drive members or wheels. Specifically, the vehicle 100 may include right front wheel 121*a*, left front wheel 121*b*, left rear wheel 121*c*, and right rear wheel (not shown), which may be individually or collectively referred to herein as driven members or wheels 121. Of course, other drive and steer configurations (e.g., actively steered front or rear wheels, tri-wheel configurations, front-wheel-only or rear-wheel-only drive, front steer, rear steer, all-wheel steer, etc.) and vehicles using ground-engaging members other than wheels (e.g., tracks, rollers), are certainly contemplated within the scope of this disclosure.

The vehicle 100 may further include a control panel including various user inputs (e.g., control levers, knobs, joysticks, push buttons, touch screens, etc.) for ease of user manipulation and control while standing on an operator platform or walking behind the vehicle 100. For example, the control panel may include implement control inputs 109 and drive control inputs 110. The operator platform may be configurable in a deployed position to receive the standing operator. In some embodiments of the vehicle 100, the operator platform may fold upwardly against a back side of the frame 102 to permit operation by an operator walking behind the vehicle 100.

As stated herein, the vehicle 100 may also include an implement system 103 having the attachment tool or implement 114 (e.g., a reciprocating hammer) adapted to perform a particular task. Although shown as carried at the front end of the frame 102, in some embodiments the implement 114 can be carried at the rear end of the frame 102. Moreover, while shown as a reciprocating hammer, other types of implements (e.g., auger, chainsaw, backhoe, bucket, stump grinder, ground leveler, grapple, etc.) are also contemplated.

In addition to the implement itself, the implement system 103 may include an arm assembly 116 and various other components used to connect and operate the implement system. In some embodiments, the arm assembly 116 includes a pair of arms positioned on opposite sides of the frame 102. The arms can be pivotally connected to the frame 102 to raise and lower the implement 114. Hydraulic actuators (e.g., cylinders) 124 (although only left side actuator is illustrated in FIG. 1, an actuator 124 may be provided on the right side of the frame 102 as well) can be connected to the arms to raise and lower the arm assembly 116 relative to the frame. In addition, a hydraulic actuator 123 may be provided and adapted to pivot an attachment plate 115. The attachment plate 115 is pivotally coupled to the end of the arm assembly 116 and supports the implement 114. By extending and retracting the actuator 123, the plate 115/implement 114 may be rotated ("curled" or extended) relative to the arm assembly as desired for transport and operation. Moreover, extension and retraction of the actuators 124 may allow lifting and lowering, respectively, of the arm assembly 116/implement 114.

The implement system 103 may be electrically and/or hydraulically coupled to the implement control input 109 to allow control of the implement 114. For example, separate implement control inputs (collectively control input(s) 109) can be operated along fore and aft axes, e.g., each may be pushed forwardly out of neutral or pulled rearwardly out of neutral. Specifically, one input may be manipulated by the user to raise and lower arm assembly 116/implement 114, another input may be manipulated to tilt the plate 115/implement 114 toward and away from the user. Also, in one embodiment, yet another input may be provided to control activation of the implement 114, such as rotation of an auger or reciprocation of the hammer. For example, in use, the implement system 103 may reciprocate the implement 114 (e.g., hammer) to penetrate and demolish ground and other structures in response to manipulation of the input.

Figure 2:
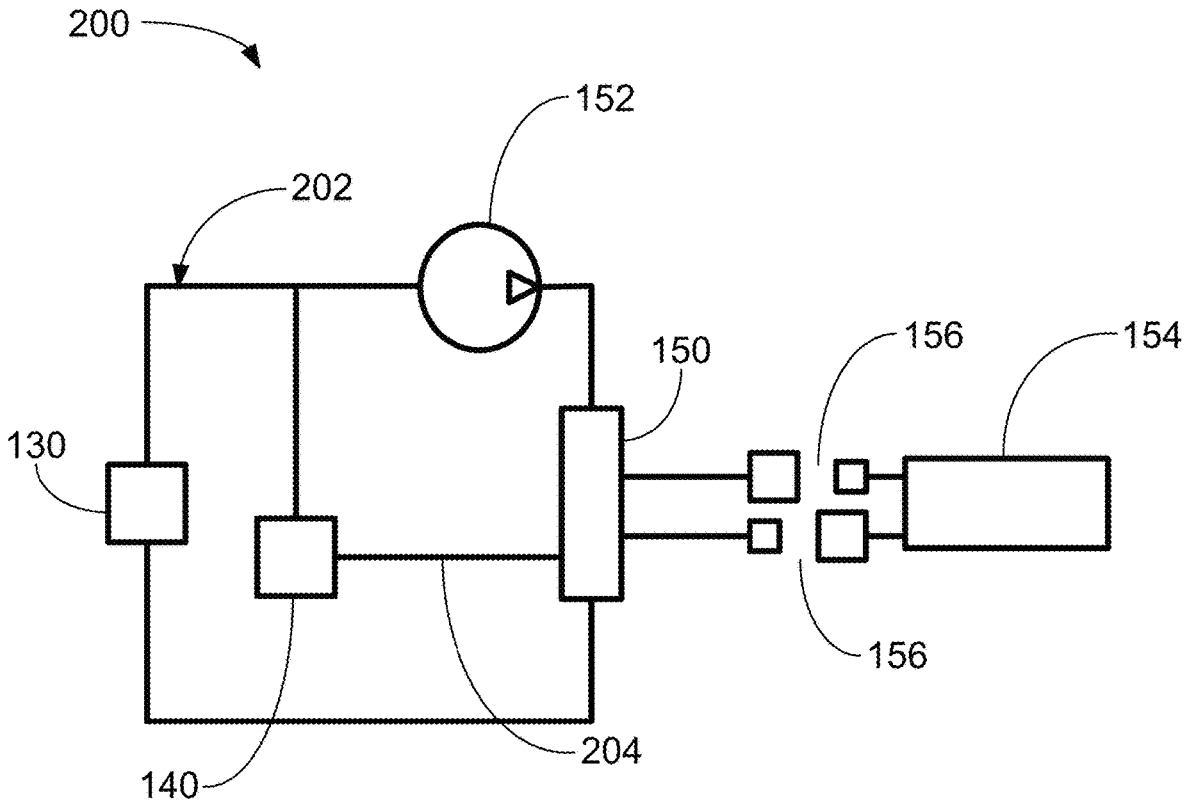
FIG. 2 is a block diagram of a hydraulic system of the exemplary utility vehicle of FIG. 1.

As shown schematically in FIG. 2, the vehicle may include a control system 200 having a hydraulic control input 130 and an operator control switch 140. The hydraulic control input 130 may be operably coupled to and configured to control a hydraulic system 202 and the operator control switch 140 may be operably coupled to and configured to control an electrical system 204. Specifically, the hydraulic control input 130 may be configured to control various aspects of the hydraulic system 202.

The hydraulic system 202—which may be powered by or otherwise operably connected to the electric motor 104—may also include one or more control valves 150 (e.g., solenoid, actuator, etc.) to assist in the actuation of one or more components associated with the hydraulic system (e.g., an implement 154 or attachment tool, e.g., an actuator associated with the implement). For example, the one or more control valves 150 may allow or restrict the flow of hydraulic fluid to the implement 154 to hydraulically actuate the implement 154 (e.g., reciprocation of a hammer). Specifically, in one or more embodiments, the hydraulic system 202 may include multiple control valves 150 to control multiple flow paths of the hydraulic fluid and/or to control various path directions of the hydraulic fluid.

Further, the hydraulic system 202 may include a pump 152 configured to provide the hydraulic fluid under pressure. Therefore, the one or more control valves 150 may be configured to control flow of hydraulic fluid from the pump 152 to the implement 154. In other words, one or more components of the vehicle 100 (e.g., the implement 154) may be operable with hydraulic power provided by the hydraulic system 202 through the one or more control valves 150 (e.g., a hydraulic actuator).

As described herein, the hydraulic control input 130 may be operably coupled to the hydraulic system 202 and configured to move one or more components (e.g., the implement 154) associated with the hydraulic system 202. In other words, the operator of the vehicle 100 may use the hydraulic control input 130 to control the implement 154 (e.g., through the one or more control valves 150). For example, as shown in FIG. 2, the hydraulic control input 130 is shown connected to the one or more control valves 150 using lines that represent hydraulic flow paths. Further, the one or more control valves 150 may be connected to the implement 154 (e.g., through a quick coupler 156 as described further herein) using lines that represent hydraulic flow paths.

The one or more components associated with the hydraulic system 202 may include the implement 154 such as, for example, an auger, a reciprocating hammer, a vibratory plow, a grapple rake, a trencher, a leveler, a box rake, a soil cultivator, a snowthrower, a stump grinder, a tiller, etc. Therefore, the hydraulic control input 130 may be used by the operator to actuate features of the implement 154. Specifically, the operator may interact with the hydraulic control input 130 to control the one or more control valves 150 and allow or restrict the flow of hydraulic fluid to the implement 154 to actuate features of the implement 154.

Figure 3:
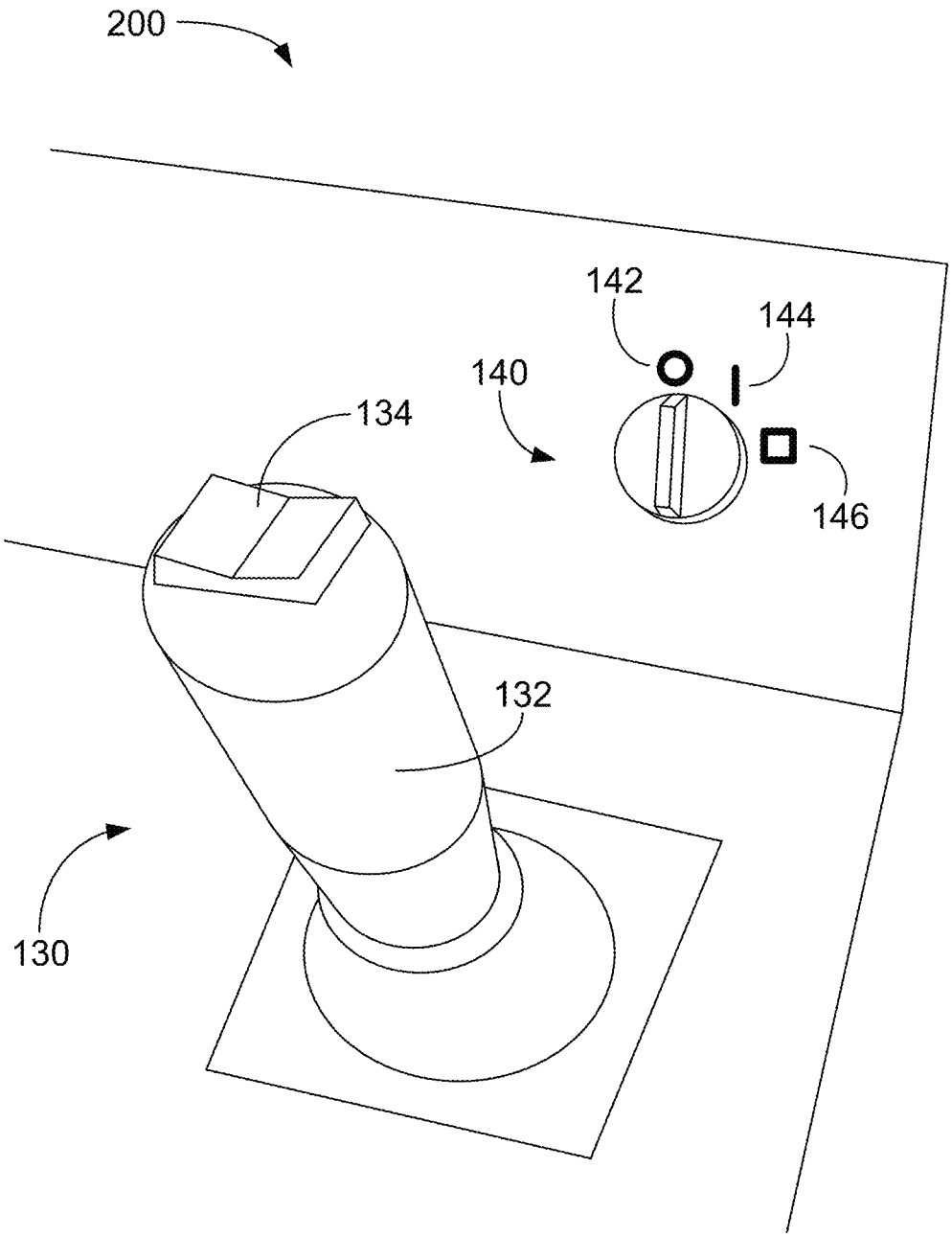
FIG. 3 is a perspective view of an illustrative control system of the utility vehicle of FIG. 1.

Further, the hydraulic control input 130 may include a variety of different types of controls. For example, the hydraulic control input 130 may include one or more of a joystick, a button, a lever, switch, etc. Specifically, as shown in FIG. 3, the hydraulic control input 130 includes a joystick 132 having a toggle switch 134 on top of the joystick 132. In one or more embodiments, the joystick 132 may be configured to move the arm assembly of the vehicle 100 and the toggle switch 134 may be configured to actuate the implement 154.

As shown in FIG. 2, the operator control switch 140 may also be operably coupled to various components of the vehicle to control aspects of the electrical system 204. For example, the operator control switch 140 may be operably coupled to and provide control and/or power to components of, the hydraulic system 202 (e.g., the one or more control valves 150 and the pump 152). The operator control switch 140 may include at least two positions. For example, in one or more embodiments, the operator control switch 140 may include a relief position such that pressure within the hydraulic system may be relieved when the hydraulic control input 130 is engaged. Specifically, the pressure within the hydraulic system may be relieved when the operator control switch 140 is in the relief position and the hydraulic control input 130 is engaged.

By moving the operator control switch 140 into the relief position, the one or more control valves 150 maintain power while the pump 152 no longer maintains power. Therefore, the hydraulic control input 130 may be engaged to actuate the one or more control valves 150 and relieve pressure within the hydraulic system 202 (e.g., without the pump 152 repressurizing the system).

The operator control switch 140 may include any suitable switch present on the vehicle 100 that may be manipulated by the operator. For example, as shown in FIG. 3, the operator control switch 140 may include a knob including various stopping positions. In other embodiments, the operator control switch 140 may include, for example, a button, lever, touchscreen, etc.

As shown in FIG. 3, the operator control switch 140 includes a first position 142, a second position 144, and the relief position 146. The first position 142 of the operator control switch 140 may be associated with an off position of the vehicle and the second position 144 of the operator control switch 140 may be associated with an on position of the vehicle 100. Therefore, when the operator control switch 140 is in the first position 142 (e.g., the off position), the one or more control valves 150 and the pump 152 may be powered off, and when the operator control switch 140 is in the second position 144 (e.g., the on position), the one or more control valves 150 and the pump 152 may be powered on. Further, as previously described, when the operator control switch 140 is in the relief position 146, the one or more control valves 150 may be powered on while the pump 152 may be powered off. Therefore, when the operator control switch 140 is in the relief position 146, hydraulic control input 130 may be used to activate the one or more control valves 150 without activating the pump 152 to, e.g., depressurize the hydraulic system 202.

Furthermore, the operator control switch 140 may be biased away from the relief position 146 (e.g., towards the second position 144) such that the operator may need to actively hold the operator control switch 140 in the relief position. Additionally, in one or more embodiments, the hydraulic control input 130 and the operator control switch 140 may be separated by a distance such that the operator cannot interact with both controls with a single hand. In other words, the hydraulic control input 130 and the operator control switch 140 may be physically positioned such that the operator uses two hands to relieve pressure in the hydraulic system 202. For example, the hydraulic control input 130 and the operator control switch 140 may be separated by a distance of at least 5 inches.

In one or more embodiments, the operator control switch 140 may be operably coupled to the electrical system of the utility vehicle such that the operator control switch is configured to power the utility vehicle on or off (e.g., including traction control). For example, the operator control switch 140 may be included with the ignition switch (e.g., replacing the start position with the relief position in an electric utility vehicle). In other embodiments, the operator control switch 140 may be defined by a standalone switch on the control panel of the vehicle 100. For example, the operator control switch 140 may be a standalone switch that is only engaged along with the hydraulic control input 130 to relieve pressure in the hydraulic system.

Figure 4:
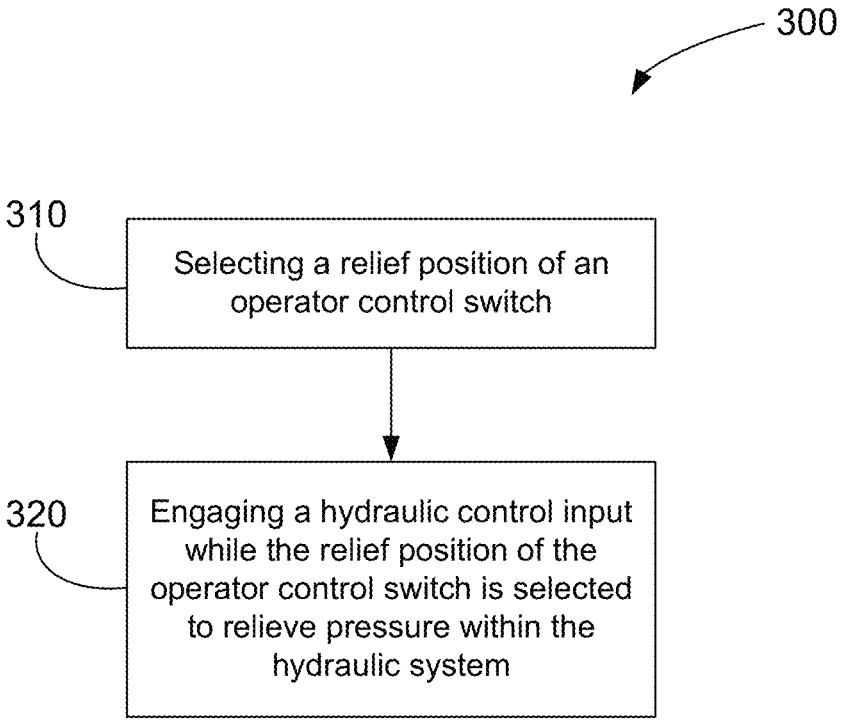
FIG. 4 is a flow diagram illustrating a method of controlling a utility vehicle in accordance with one embodiment of the present disclosure.

A method 300 of controlling a utility vehicle to relieve pressure in a hydraulic system of a vehicle (e.g., vehicle 100) is shown in FIG. 4. The method 300 may include selecting at 310 a relief position of an operator control switch. The operator control switch may be operably coupled to a hydraulic system of the utility vehicle and may include at least two positions. The method 300 may also include engaging at 320 a hydraulic control input while the relief position of the operator control switch is selected to relieve pressure within the hydraulic system. The hydraulic control input may be coupled to the hydraulic system and may be configured to move one or more components associated with the hydraulic system.

In one or more embodiments, selecting the relief position of the operator control switch may include maintaining the operator control switch in the relief position. For example, the operator may hold the operator control switch in the relief position otherwise the operator control switch may move away from the relief position. In one or more embodiments, the method may also include releasing the operator control switch after pressure is relieved within the hydraulic system. In one or more embodiments, the method may also include removing an implement from the utility vehicle after pressure is relieved within the hydraulic system.

In some embodiments, passing the operator control switch 140 (see FIG. 3) from the relief position 146 to the off position 142 will momentarily activate the hydraulic circuit as the switch passes through the on position 144. This may thus pressurize the hydraulic circuit and activate the attachment. Accordingly, the operator may need to release the hydraulic control input 130 before moving the switch 140 either to the on position or the off position.

Illustrative embodiments are described herein, and reference has been made to possible variations of the same. These and other variations, combinations, and modifications will be apparent to those skilled in the art, and it should be understood that the claims are not limited to the illustrative embodiments set forth herein. It should also be understood that, depending on the example, certain acts or events of any of the processes or methods described herein may be performed in a different sequence, may be added, merged, or left out altogether (e.g., all described acts or events may not be necessary to carry out the techniques). In addition, while certain aspects of this disclosure are described as being performed by a single module or unit for purposes of clarity, it should be understood that the techniques of this disclosure may be performed by a combination of units or modules associated with, for example, a utility loader.

The complete disclosure of the patents, patent documents, and publications cited herein are incorporated by reference in their entirety as if each were individually incorporated. In the event that any inconsistency exists between the disclosure of the present application and the disclosure(s) of any document incorporated herein by reference, the disclosure of the present application shall govern.

Illustrative embodiments are described and reference has been made to possible variations of the same. These and other variations, combinations, and modifications will be apparent to those skilled in the art, and it should be understood that the claims are not limited to the illustrative embodiments set forth herein.

What is claimed is:

1. A control system of a utility vehicle, the control system comprising:

a hydraulic control input operably coupled to a hydraulic system of the utility vehicle and configured to move one or more components associated with the hydraulic system; and an operator control switch operably coupled to the hydraulic system and comprising at least two positions, wherein pressure within the hydraulic system is relieved when the operator control switch is in a relief position and the hydraulic control input is engaged, and wherein the operator control switch is biased away from the relief position.

2. The control system of claim 1, wherein the operator control switch comprises a first position, a second position, and the relief position.

3. The control system of claim 1, wherein the hydraulic control input and the operator control switch are separated by at least 5 inches.

4. The control system of claim 1, wherein the one or more components associated with the hydraulic system comprises a hydraulic actuator.

5. The control system of claim 1, wherein the one or more components associated with the hydraulic system comprises an implement.

6. The control system of claim 1, wherein the hydraulic system comprises a control valve and a pump, wherein the pump is configured to provide hydraulic fluid under pressure and the control valve is configured to control flow of hydraulic fluid from the pump, wherein activation of the control valve without activation of the pump relieves pressure within the hydraulic system.

7. The control system of claim 1, wherein the operator control switch is operably coupled to an electrical system of the utility vehicle such that the operator control switch is configured to power the utility vehicle on or off.

8. The control system of claim 1, wherein the hydraulic control input comprises one or more of a joystick, a button, a lever, and a switch.

9. A utility vehicle comprising:

a frame;

an electric motor supported on the frame;

a hydraulic system operably coupled to the electric motor, wherein the hydraulic system is configured to provide hydraulic power to one or more components of the utility vehicle;

a hydraulic control input operably coupled to the hydraulic system and configured to move the one or more components; and an operator control switch operably coupled to the hydraulic system and comprising at least two positions, wherein pressure within the hydraulic system is relieved when the operator control switch is in a relief position and the hydraulic control input is engaged, and wherein the operator control switch is biased away from the relief position.

10. The utility vehicle of claim 9, wherein the operator control switch comprises a first position, a second position, and the relief position.

11. The utility vehicle of claim 9, wherein the hydraulic control input and the operator control switch are separated by at least 5 inches.

12. The utility vehicle of claim 9, wherein the one or more components of the utility vehicle comprises an implement operable with the hydraulic power received from the hydraulic system.

13. The utility vehicle of claim 9, wherein the hydraulic system comprises a control valve and a pump, wherein the pump is configured to provide hydraulic fluid under pressure and the control valve is configured to control flow of hydraulic fluid from the pump, wherein activation of the control valve without activation of the pump relieves pressure within the hydraulic system.

14. The utility vehicle of claim 9, wherein the operator control switch is operably coupled to an electrical system of the utility vehicle such that the operator control switch is configured to power the utility vehicle on or off.

15. The utility vehicle of claim 9, wherein the hydraulic control input comprises one or more of a joystick, a button, a lever, and a switch.

16. A method of controlling a utility vehicle, the method comprising:

selecting a relief position of an operator control switch, wherein the operator control switch is operably coupled to a hydraulic system of the utility vehicle and comprises at least two positions, and wherein selecting the relief position comprises maintaining the operator control switch in the relief position against a biasing force; and engaging a hydraulic control input while the relief position of the operator control switch is selected to relieve pressure within the hydraulic system, wherein the hydraulic control input is coupled to the hydraulic system and configured to move one or more components associated with the hydraulic system.

17. The method of claim 16, further comprising releasing the operator control switch after pressure is relieved within the hydraulic system.

* * * * *